US009418784B2

(12) United States Patent
Lindenthal et al.

(10) Patent No.: US 9,418,784 B2
(45) Date of Patent: Aug. 16, 2016

(54) ELECTRICAL CONNECTION CONFIGURATION FOR AN IGNITION COIL

(75) Inventors: Konstantin Lindenthal, Blaichach (DE); Juergen Raedler, Burgberg (DE); Thomas Pawlak, Immenstadt (DE); Florian Herzog, Bad Hindelang (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/113,810

(22) PCT Filed: Mar. 26, 2012

(86) PCT No.: PCT/EP2012/055344

§ 371 (c)(1),
(2), (4) Date: Jan. 6, 2014

(87) PCT Pub. No.: WO2012/146448

PCT Pub. Date: Nov. 1, 2012

(65) Prior Publication Data

US 2014/0218154 A1 Aug. 7, 2014

(30) Foreign Application Priority Data

Apr. 28, 2011 (DE) ..... 10 2011 017 727
Sep. 7, 2011 (DE) ..... 10 2011 082 230

(51) Int. Cl.
*H01F 27/29* (2006.01)
*H01F 27/30* (2006.01)
(Continued)

(52) U.S. Cl.
CPC ..... *H01F 27/29* (2013.01); *H01R 4/14* (2013.01); *H01R 4/2416* (2013.01)

(58) Field of Classification Search
CPC ..... H01F 5/02; H01F 5/04; H01F 5/06; H01F 27/29; H01F 27/32; H01F 27/324; H01F 27/325; H01F 27/28; H01F 27/02; H01F 27/2828; H01F 38/12; H02P 13/00; H02P 3/04
USPC ..... 336/192, 198, 208, 90; 29/606, 602.1
See application file for complete search history.

(56) References Cited

U.S. PATENT DOCUMENTS 5,295,861 A * 3/1994 Peretick et al. ..... 439/527
2005/0140481 A1* 6/2005 Kojima et al. ..... 336/90
(Continued)

FOREIGN PATENT DOCUMENTS

CN 101834049 A 9/2010
DE 102 51 841 5/2004
(Continued)

OTHER PUBLICATIONS

International Search Report for PCT/EP2012/055344, dated May 24, 2012.

*Primary Examiner* — Mangtin Lian
(74) *Attorney, Agent, or Firm* — Norton Rose Fulbright US LLP

(57) ABSTRACT

An electrical connection configuration, e.g., for an ignition coil, includes: an enameled wire sheathed in insulating enamel, and a contact element for the electrical contacting of the enameled wire, the contact element having a contact region for the electrical contacting of the enameled wire. The contact region has at least one sharp edge, and the enameled wire is routed along the sharp edge, such that a region of the enameled wire stripped of the enamel is provided, which rests against the contact region of the contact element for the electrical contacting.

7 Claims, 3 Drawing Sheets

(51) Int. Cl.
*H01R 4/14* (2006.01)
*H01R 4/24* (2006.01)

(56) References Cited

U.S. PATENT DOCUMENTS

2006/0255898 A1* 11/2006 Sawazaki et al. ..... 336/90
2010/0068915 A1 3/2010 Kahl
2013/0033352 A1* 2/2013 Wo ..... 336/192

FOREIGN PATENT DOCUMENTS

EP 0 176 607 4/1986
WO WO 2008/025626 3/2008

* cited by examiner

ELECTRICAL CONNECTION CONFIGURATION FOR AN IGNITION COIL

BACKGROUND OF THE INVENTION

1. Field of the Invention

The present invention relates to an electrical connection configuration, in particular for an ignition coil or a sensor, and especially to the electrical contacting of thin enameled wires.

2. Description of the Related Art

Ignition coils in various developments are known from the related art. One set of problems concerns the contacting of thin enameled wires which are used as secondary windings for ignition coils, in particular. The related art frequently employs hot contacting, by welding or soldering. As an alternative, published German patent application document DE 102 51 841 A1 proposes cold contacting, in which a contacting spring is lifted above coils of enameled wire and then snaps into place by a spring-type design, so that elements provided on the contacting spring puncture an insulation layer of the enameled wires for an electrical connection. In some cases, however, electrical contacting using the snap-in process is problematic. It would therefore be desirable to achieve a cold electrical connection between an enameled wire and a contact element.

BRIEF SUMMARY OF THE INVENTION

In contrast, the electrical connection configuration according to the present invention has the advantage that cold contacting between a thin enameled wire and a contact element is possible in a simple and rapid manner. In particular, the present invention requires no separate step for removing the enamel on the enameled wire, since this is done during the production of the electrical connection configuration according to the present invention. Furthermore, the electrical connection configuration according to the present invention has the advantage that no additional factory expenditure and no additional assembly steps are necessary. Another great advantage of the present invention is that no additional space, such as for welding tongs etc., has to be provided, so that a component which uses the electrical connection configuration according to the present invention is able to be have a more compact form. In the present invention this is achieved in that the contact element has a contact region, which is provided with at least one sharp edge for the electrical contacting of the enameled wire. The enameled wire is bent at the sharp edge, in such a way that a region without enamel is created for the electrical contacting with the contact element. The region of the wire without enamel then rests against the contact element, especially at the sharp edge. The electrical connection configuration preferably is used for ignition coils or for sensors, such as engine speed sensors, for example.

In an especially preferred way, the enameled wire is guided across the sharp edge of the contact region on the contact element multiple times. This makes it possible to establish electrical contacting with multiple regions of the enameled wire.

Furthermore, the enameled wire preferably forms a contact winding featuring multiple turns in the contact region. In other words, the enameled wire is wound around a subsection of the contact element several times in order to form a plurality of turns. The sharp edge is formed at the coiled subsection of the contact element.

It is advantageous if the turns of the enameled wire at the sharp edge are positioned next to each other and in at least one layer on top, since this ensures that the layers not situated directly at the sharp edge exert prestress on the layer situated directly at the sharp edge. This guarantees excellent electrical contact.

Especially preferably, a free end of the enameled wire is situated between turns of the contact winding on the contact element, in such a way that the free end does not project from the contact winding. The free end of the enameled wire lies between the turns because the prestress exerted when winding the coil pulls it into the interior of the contact winding once the enameled wire is torn. In other words, the free end of the enameled wire is covered by the turns, so that no free projecting wire end is present. This makes it possible to prevent an electrical field elevation, so that the free projecting wire end is unable to cause any undesired flashovers, in particular at a high-voltage output.

Especially preferably, the contact region on the contact element is formed at a constriction of the contact element. This allows an uncomplicated fixation of the enameled wire, e.g., by winding it multiple times in the region of the constriction. It is furthermore preferred if a plurality of sharp edges, especially four edges, are provided in the region of the constriction.

It is furthermore preferred if the sharp edge in the contact region has the shape of an arc, especially the form of a divided circle. The arc-shaped development provides a long contact between the sharp edge and the outer circumference of the enameled wire, so that a relatively large quantity of enamel is able to be scraped off from the enameled wire by the sharp edge. This improves the electrical contactability.

According to another preferred development of the present invention, edges of the contact element lying adjacent to the sharp edge are rounded. This guides the wire towards the constriction and ensures that the enameled wire does not inadvertently come into contact with a sharp edge at an undesired spot and the enamel or the copper conductor suffers damage while the enameled wire is fixed in place on the contact element.

Furthermore preferably, the contact element provides electrical contact to a secondary coil of the ignition coil. The secondary coil preferably is directly wound with the enameled wire.

In addition, the electrical connection configuration preferably includes a second contact element, which forms a high-voltage outlet of the ignition coil. The second contact element has the same design as the first contact element, so that a high number of identical parts is able to be obtained, in particular.

It is also advantageous if the contact element has a slot for accommodating the diode wire, since this allows a second contact to the diode wire to be established in a manner that is optimized with regard to space.

Furthermore, the present invention relates to an ignition coil having an electrical connection configuration according to the present invention, preferably having two electrical connection configurations according to the present invention.

In addition, the present invention relates to a method for the electrical contacting of an enameled wire with a contact element, in which the contact element, which has a contact region that features a sharp edge, is provided in a first step, and then an enameled wire is guided across the sharp edge in such a way that the enamel is stripped off in a subregion of the enameled wire, and the region of the enameled wire without enamel is brought into contact with the contact region for the electrical contacting. In this way the present invention makes it possible to achieve reliable electrical contacting simply by routing the enameled wire across the sharp edge. It is especially preferred if the enameled wire is routed across the sharp edge multiple times in order to increase the number of contact points. Furthermore, in the present invention a contact winding is preferably provided in that the enameled wire is wound multiple times directly over the coils that have direct contact with the sharp edge, so as to achieve a constriction of the coils lying underneath with the goal of providing excellent contact.

DETAILED DESCRIPTION OF THE INVENTION

In the following text, an electrical connection configuration 2 for an ignition coil 1 will be described with reference to FIGS. 1 through 6.

Figure 1:
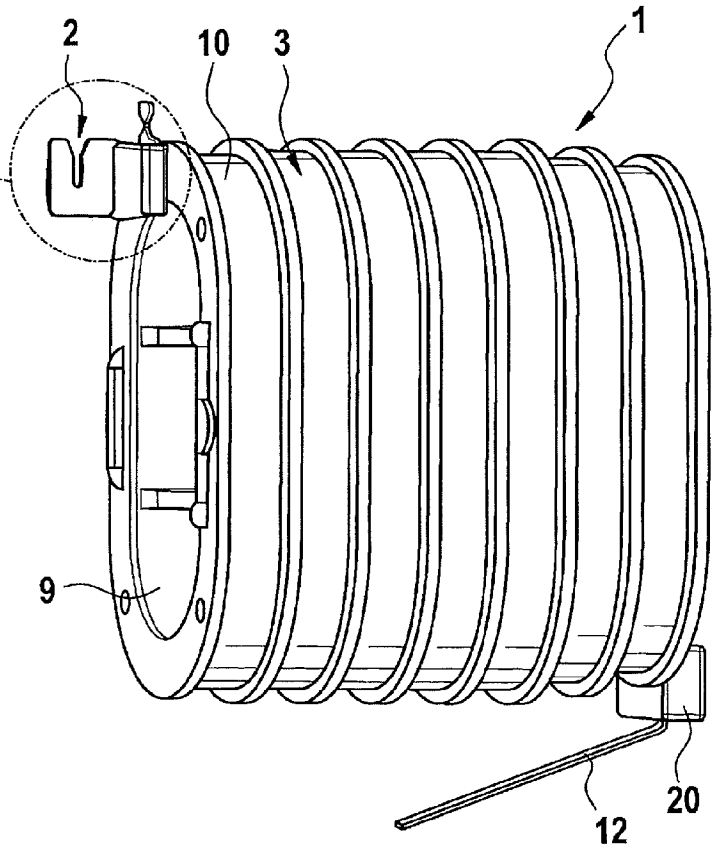
FIG. 1 shows a schematic perspective view of an ignition coil including an electrical connection configuration according to a preferred specific embodiment of the present invention.

As can be gathered from FIG. 1, ignition coil 1 has a coil shell 9, onto which a secondary winding 10 has been wound. Secondary winding 10 consists of wound enameled wire 3, i.e., of an electrically conductive wire sheathed in insulating enamel. Enameled wire 3 has a very small diameter, such as less than 0.15 mm. At the beginning and at the end of secondary winding 10, electrical contact must be established by means of an electrical connection configuration 2. As can be gathered from FIG. 1, two electrical connection configurations 2, 20 are situated at the beginning and the end of secondary winding 10 in this exemplary embodiment. The electrical contact elements in particular have the same design in both electrical connection configurations 2, 20.

Figure 5:
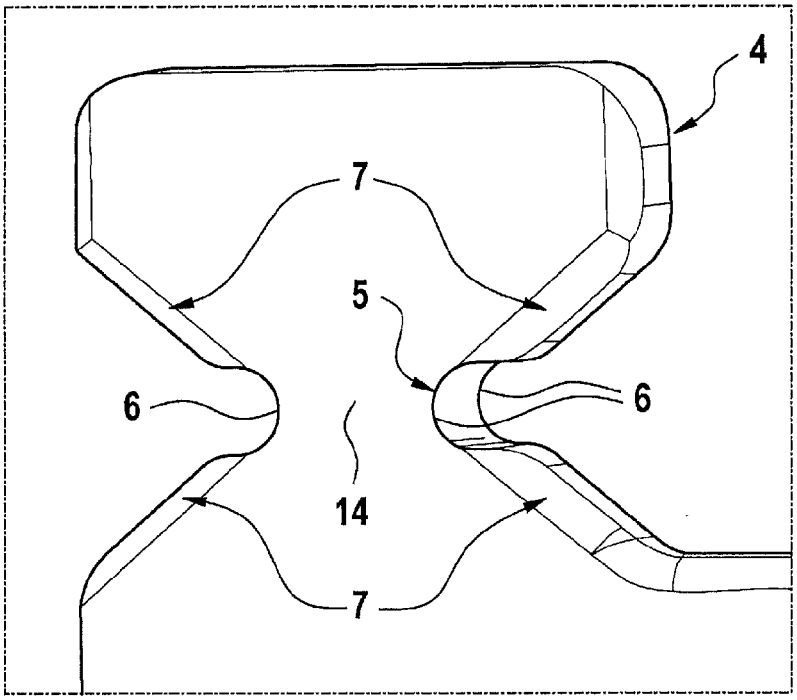
FIG. 5 shows an enlarged partial view of FIG. 4.
Figure 6:
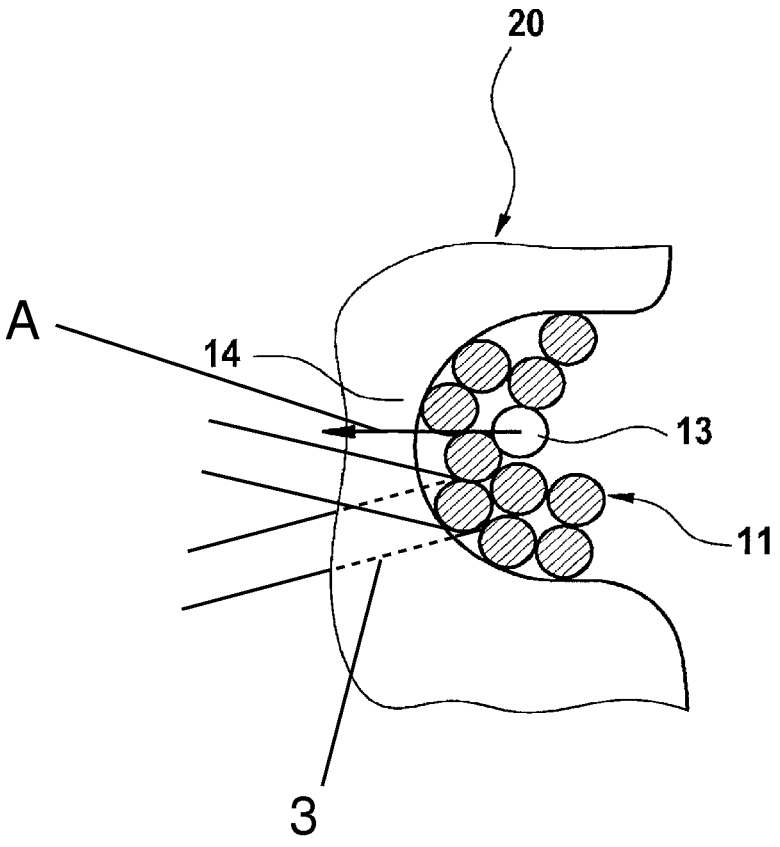
FIG. 6 shows a part-sectional schematic view of an electrical connection configuration for a high-voltage output.

As shown in FIGS. 2 through 5, electrical connection configuration 2 includes a contact element 4 for the electric contacting of enameled wire 3. In particular from FIG. 4 it can be gathered that, for example, contact element 4 is formed in one piece with a cut-clamp connection 8, which is situated at a 90 degree angle. Cut-clamp connection 8 is designed to link an electrical connection. FIG. 5 shows contact element 4 in detail; it has a contact region 5, which, for instance, is formed at a constriction 14 of contact element 4. Constriction 14 is produced by a punching process, for example, in the course of which entire contact element 4 together with integrated cut-clamp device 8 is produced from sheet metal. Because of the punching burr, the punching process results in four sharp edges 6 in contact region 5. At least one sharp edge 6 is required. As shown in FIG. 5, in particular, sharp edges 6 are implemented in the geometric form of an arc. Constriction 14 is U-shaped, V-shaped, implemented in the shape of a keyhole, a slot or a rectangle, for example. Contact region 5 is developed in such a way that a plurality of layers of enameled wire 3 is able to be positioned next to each other and on top of each other.

Edges 7 adjacent to sharp edges 6 form an insertion region, edges 7 being rounded, as shown in FIG. 5. Because of the insertion region, enameled wire 3 is fed through to contact region 5 having sharp edges 6 without sustaining damage in the process.

Figure 2:
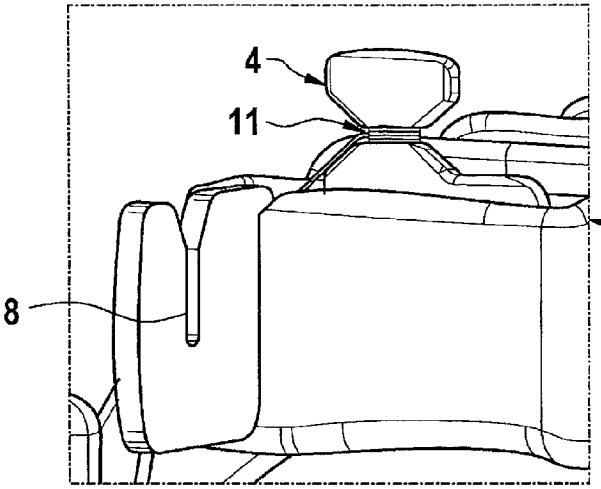
FIG. 2 shows an enlarged partial view of FIG. 1.
Figure 3:
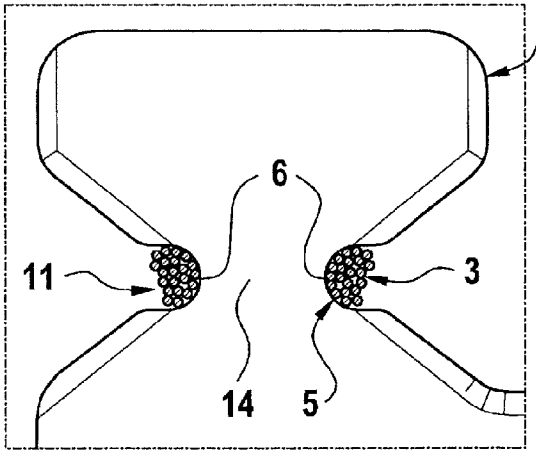
FIG. 3 shows a part-sectional view of a contact element having enameled wire wound around it.
Figure 4:
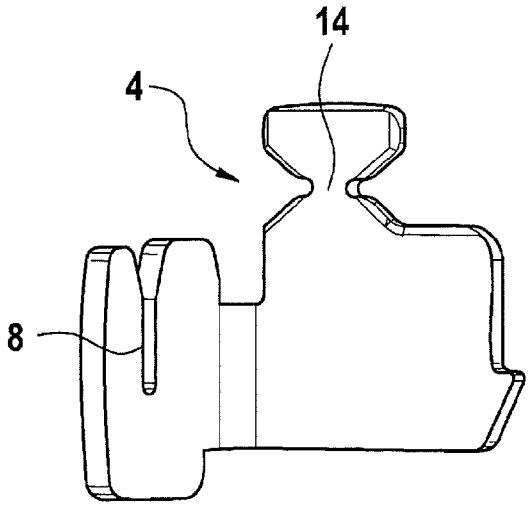
FIG. 4 shows a perspective view of the contact element without wire.

FIGS. 2 and 3 show the way in which enameled wire 3 is situated on contact element 4. Enameled wire 3 is wound around contact region 5 or constriction 14 in multiple turns and produces at least one contact winding 11 in contact region 5 in the process. The sections of the enameled wire lying against sharp edges 6 of contact region 5 are at least sectionally without enamel, since the winding process causes sharp edges 6 to penetrate the enamel layer of enameled wire 3, so that electrical contact is established between contact element 4 and the enameled wire. Enameled wire 3 is situated in contact region 5 or constriction 14 in such a way that a plurality of layers is situated next to each other at sharp edge 6, and at least one layer, for instance a plurality of layers, is situated on top.

The fact that contact region 5 or constriction 14 is wound multiple times ensures that the turns lying on the outside constrict the inner turns lying underneath. This results in a long-lasting contact force between the enameled wire regions without enamel and contact element 4. Once contact winding 11 has been produced, enameled wire 3 may be routed into the winding space on the coil shell, and secondary winding 10 be wound around coil shell 9.

The same contact winding 11 then is situated at second electrical connection configuration 20, reference numeral 12 denoting a high-voltage output of ignition coil 1 (FIG. 1).

An electrical contact between high-voltage output 12 and enameled wire 3 is achieved in the same way as described in FIGS. 2 through 5. Furthermore, as can be gathered from FIG. 6, a free end of the enameled wire is pulled into the coils, for instance through an increased winding tension, once the final turn of contact winding 11 has been produced. Enameled wire 3 breaks off in the process and thereby produces free enameled wire end 13. However, because it is pulled inside, free enameled wire end 13 is not freely exposed, but disappears in the turns. As a result, free enameled wire end 13 is no longer able to pose a problem in terms of high-voltage technology and, in particular, undesired sparkovers from free enameled wire end 13 to mass-carrying components, e.g., the magnetic circuit of the ignition coil or the spark plug well, are able to be avoided.

Contact element 4 may have a slot to accommodate a diode wire. In this way a second contacting to the diode wire is able to take place in a manner that is optimized with regard to space.

An especially compact ignition coil is therefore able to be provided, inasmuch as no free spaces, such as for welding tongs etc., as required for the warm contacting carried out according to the related art, have to be provided for the contacting of the ignition coil. Simple cold contacting may be used in the present invention, without any need to isolate the enameled wire beforehand. In the present invention this is done by the winding step at sharp edges 6. Moreover, in the present invention, the electrical contacting is integrated into contact element 4, so that no other additional components are necessary. The electrical contacting is able to be carried out in a very simple and cost-effective manner, and thus results in great production-related advantages since electrical connection configurations 2 of this type constitute mass-produced goods. In addition, the electrical contacting may be established without additional installation steps and in a manner that will not affect plant output cycles.

What is claimed is:

1. An electrical connection configuration for an ignition coil, comprising:

an enameled wire, wherein the enameled wire includes an electrically conductive wire sheathed in insulating enamel; and a first contact element for the electrical contacting of the enameled wire, wherein the contact element has a contact region for the electrical contacting of the enameled wire, the contact region having a sharp edge, and the enameled wire is routed along the sharp edge in such a way that a region of the enameled wire without enamel is present, said region of the enameled wire without enamel rests against the sharp edge of the contact region of the contact element for the electrical contacting;

wherein the region of the enameled wire without enamel is situated between further regions of the enameled wire with enamel, wherein the enameled wire is routed over the sharp edge of the contact region multiple times, wherein the enameled wire forms a contact coil in the contact region, the contact coil having multiple turns, wherein the turns of the enameled wire are situated next to each other at the sharp edge, and in at least one layer above the sharp edge, wherein the contact region is formed at a constriction of the contact element, and the at least one sharp edge is situated at the constriction, and wherein the contact element provides electrical contacting for thin wires of a secondary winding of the ignition coil.

2. The configuration as recited in claim 1, wherein the multiple turns of the contact coil is in the range of fifteen to eighteen turns.

3. The configuration as recited in claim 2, wherein a free enameled wire end is situated between the turns of the contact coil.

4. The configuration as recited in claim 1, wherein the at least one sharp edge is shaped in the form of an arc.

5. The configuration as recited in claim 1, wherein additional edges of the contact element situated adjacent to the at least one sharp edge are rounded.

6. The configuration as recited in claim 2, further comprising:

a second contact element at a high-voltage output, wherein the second contact element has the same configuration as the first contact element.

7. The configuration as recited in claim 2, wherein the contact element has a slot.

* * * * *